US010392800B1

(12) United States Patent
Shin et al.

(10) Patent No.: US 10,392,800 B1
(45) Date of Patent: Aug. 27, 2019

(54) SYSTEM AND METHOD FOR BUILDING STRUCTURES USING MULTILAYERED PANEL FRAMES

(71) Applicant: SHIN CIVIL ENGINEERING CONSULTANTS INC., San Francisco, CA (US)

(72) Inventors: Jae Min Shin, San Francisco, CA (US); Ashkan Ferozepurwalla, Davis, CA (US)

(73) Assignee: Shin Civil Engineering Consultants Inc., San Francisco, CA (US)

( * ) Notice: Subject to any disclaimer, the term of this patent is extended or adjusted under 35 U.S.C. 154(b) by 0 days.

(21) Appl. No.: 15/299,461

(22) Filed: Oct. 21, 2016

Related U.S. Application Data

(60) Provisional application No. 62/244,193, filed on Oct. 21, 2015.

(51) Int. Cl.
*E04C 2/34* (2006.01)
*E04B 1/02* (2006.01)
(Continued)

(52) U.S. Cl.
CPC ..... *E04C 2/34* (2013.01); *E04B 1/02* (2013.01); *E04B 1/10* (2013.01); *E04C 2002/001* (2013.01)

(58) Field of Classification Search
CPC ..... E04C 2/34; E04C 2002/001; E04B 1/02; E04B 1/10
(Continued)

(56) References Cited

U.S. PATENT DOCUMENTS 1,398,852 A * 11/1921 Gilbert ..... A63H 33/102 24/336
2,820,990 A * 1/1958 Johnson ..... E04B 1/3211 52/461
(Continued)

FOREIGN PATENT DOCUMENTS

EP 1992751 11/2008

*Primary Examiner* — Joshua K Ihezie
(74) *Attorney, Agent, or Firm* — Dentons US LLP

(57) ABSTRACT

The present invention is to provide assemblies with polygon shaped panel frames, separators and parts for light weight construction that is versatile, rigid, flexible and structurally stable. The assemblies with polygon shaped panel frames, separators and parts for constructing a complete building structure eliminates the need for conventional framing using unitized polygon shaped panel frames with alignment pieces, separators and fastener parts connected together. The assemblies with polygon shaped panel frames, separators and parts comprises of panel frames which are different geometric shapes or polygon parts, including but not limited to circles, ovals, triangles, trapezoids, rectangles, squares, pentagons, hexagons, etc. Panel frames can be hollowed or solid and can be fabricated as pieces of and in itself. Panel frames can be composed of many types of materials including but not limited to wood, metal, polymers, composites, plastics, etc. Two (2) or more panel frames are connected with fasteners utilizing a "link". Links are parts that create separation between the panel frames and also conjoin other panel frames. Links provide load transfer and can be made of polymers, wood, composites, metal, plastics, etc. The panel frames and links are connected together using fasteners like screws, bolts, nuts, tee-nuts, rivets, rivet nuts, couplers, standoffs, dowels, etc. The panel frames and links are designed to repeat and can provide a building structure with window and doorway openings space and utility space for electrical and plumbing installations. Further, the assem-
(Continued)

blies can be easily rearranged and reassembled to achieve the desired configuration at low cost, efficient time and minimal labor.

18 Claims, 15 Drawing Sheets

(51) Int. Cl.
*E04B 1/10* (2006.01)
*E04C 2/00* (2006.01)

(58) Field of Classification Search
USPC ..... 52/311.1, 81.1, 81.4, 81.5
See application file for complete search history.

(56) References Cited

U.S. PATENT DOCUMENTS 2,910,737 A * 11/1959 MacMillan ..... A63H 33/088 446/106
2,944,370 A * 7/1960 Malarkey ..... E04B 1/3211 220/4.28
2,958,918 A * 11/1960 MacMillan ..... A63H 33/108 249/132
3,082,489 A * 3/1963 Douglas ..... E04B 5/04 52/261
3,235,920 A * 2/1966 Davis ..... E04B 1/6158 411/477
3,343,324 A * 9/1967 Gordon ..... E02D 29/06 277/641
3,344,565 A * 10/1967 Nye ..... E04B 1/3211 52/281
3,691,704 A * 9/1972 Novak ..... A63F 9/12 220/4.12
3,727,354 A 4/1973 Powel
3,844,074 A * 10/1974 Ahern ..... E04B 1/1903 52/81.4
3,894,367 A * 7/1975 Yacoboni ..... E04B 1/3211 52/81.2
3,999,337 A * 12/1976 Tomassetti, Jr. ..... E04B 1/3211 454/334
4,046,248 A * 9/1977 Goffredo ..... B21D 43/057 198/583
4,075,813 A * 2/1978 Nalick ..... E04B 1/3211 52/745.07
4,287,690 A * 9/1981 Berger ..... E04B 1/3211 52/81.4
4,611,441 A * 9/1986 Wickens ..... E04B 1/3211 52/81.4
4,648,223 A * 3/1987 Richard ..... E04B 1/19 403/171
4,740,654 A * 4/1988 Lindgren ..... H05K 9/0001 174/371
4,798,032 A * 1/1989 Rose, Jr. ..... E04B 1/3211 52/309.9
5,140,790 A * 8/1992 Modglin ..... E04B 1/3211 52/586.1
5,261,194 A * 11/1993 Roberts ..... E04B 1/3211 52/285.1
5,426,900 A 6/1995 Springer
5,452,555 A * 9/1995 Lee ..... E04B 1/3211 403/388
5,560,151 A 10/1996 Roberts
6,070,373 A * 6/2000 Diamond ..... E04B 1/19 52/81.1
6,151,743 A * 11/2000 Church ..... B29C 53/585 14/73
6,282,849 B1 * 9/2001 Tuczek ..... E04B 1/32 52/648.1
6,658,800 B2 * 12/2003 Monson ..... E04B 1/3211 52/81.1
7,458,186 B2 * 12/2008 Carter ..... A63H 33/008 446/108
8,191,318 B2 * 6/2012 Kitagawa ..... E04B 1/3205 52/79.4
8,701,357 B2 4/2014 Kovel
8,752,340 B1 * 6/2014 Hartman ..... E04B 1/3211 52/80.1
8,789,318 B1 * 7/2014 Sun ..... E04B 1/3211 52/81.1
2002/0078635 A1 * 6/2002 Monson ..... E04B 1/3211 52/81.1
2002/0166294 A1 * 11/2002 Rogers ..... E04B 7/102 52/81.1
2004/0221529 A1 * 11/2004 Zornes ..... E04B 1/14 52/311.1
2007/0164481 A1 * 7/2007 Polk ..... B29C 31/047 264/320
2008/0066393 A1 * 3/2008 Sorensen ..... A63H 33/101 52/81.1
2011/0143110 A1 * 6/2011 Tsuchiya ..... B29C 70/08 428/213
2016/0258152 A1 * 9/2016 Bierschenk ..... E04B 1/3211

* cited by examiner

SYSTEM AND METHOD FOR BUILDING STRUCTURES USING MULTILAYERED PANEL FRAMES

FIELD OF INVENTION

Generally, embodiments of disclosure relate to building structures. Specifically, embodiments relate to building layers of panel framing using pre-fabricated geometric frames, separators and parts that construct various types of structures.

BACKGROUND

Construction is the process of creating and building infrastructure or a facility using various methods and materials. In conventional wood-frame building construction, composite framing members (studs, joists, or rafters) are covered with lumber, or wide flat panels, to form walls, roofs, and floors. These framing materials are engineered products that must be custom manufactured for every structure, requiring manual cuts to achieve geometry desired in a particular building. The manufacturing process of framing materials requires skilled labor, multitude of tools and systematic planning. Traditionally, in conventional wood frame construction, carpenters purchase lumber and work on it onsite to get the desired shape, often leading to wastage of resources.

Other types of conventional construction methods, include brick and mortar, and concrete masonry units (CMU). These methods and materials are typically heavy and provide minimal tensile strength for a given structure. Another existing construction method includes steel frame construction. However, cost and skilled labor are huge constraints of this construction method.

Latest means of constructions include Structurally Insulated Panels or modular construction, which involves pre-fabricated units that are custom built offsite and eventually connected into place. These typically, require a long design and planning period and may be difficult in areas with overhead issues as they are typically assembled onsite with a crane. Additionally, they are expensive and can be difficult for future alterations and additions.

In light of the above discussion, there is a need to provide building assemblies using pre-fabricated frames that construct various types of structures for efficiency and durability.

OBJECT OF INVENTION

The principal object of the invention herein is to provide assemblies and construction of "Panel Framing" which consists of connecting polygon shaped panel frame parts, with a separator "Link", attached to or through with alignment pieces and fasteners.

Another object of the invention is to provide structural support though the polygon shaped panel frames, separators and parts, eliminating the need for conventional framing.

Still another object of assemblies with polygon shaped panel frames, separators and parts is to provide support with space for utility in which the electrical wiring conduits, plumbing and other utilities can be effortlessly installed.

Still another object of the invention is to provide assemblies with polygon shaped panel frames, separators and parts in a unique polygon shaped paneling which can be designed for disassembly and reassembly quickly and efficiently.

Still another object of the invention is to provide a pre-fabricated design of construction for alignment and connections that can be repeated for easy customization of building.

Still another object of the invention is to provide assemblies with polygon shaped panel frames, separators and parts that eliminate the need for most continuous vertical frame supports.

Still another object of the invention is to provide assemblies with windows and doorways for interior walls and roofs Still another object of the invention is to provide a prefabricated housing structure and system for low cost housing.

Another object of the present invention is to provide an inexpensive system of construction that can save time and allow easy construction requiring no formal training.

Another object of the invention is to provide assemblies with polygon shaped panel frames, separators and parts for light weight construction with rigidity, versatility, flexibility and structural stability.

It is therefore an object of the present invention to provide a new and improved method of construction, utilizing assemblies with polygon shaped panel frames, separators and parts for building.

SUMMARY

The above-mentioned needs are met by assemblies with polygon shaped panel frames, separators and parts to provide structural support of a building.

An example of a system for building structures includes using assemblies with polygon shaped panel frames, separators and parts for light weight construction that is versatile, rigid, flexible and structurally stable. This system of building includes a plurality of panel frames that are pre-fabricated. In addition, a plurality of separator links and fasteners are used within the assemblies with the panel frames, alignment pieces, and parts.

These and other aspects of the embodiments herein will be better appreciated and understood when considered in conjunction with the following description and accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE VIEWS OF DRAWINGS

In the accompanying figures, similar reference numerals may refer to identical or functionally similar elements. These reference numerals are used in the detailed description to illustrate various embodiments and to explain various aspects and advantages of the present disclosure.

Figure 8A:
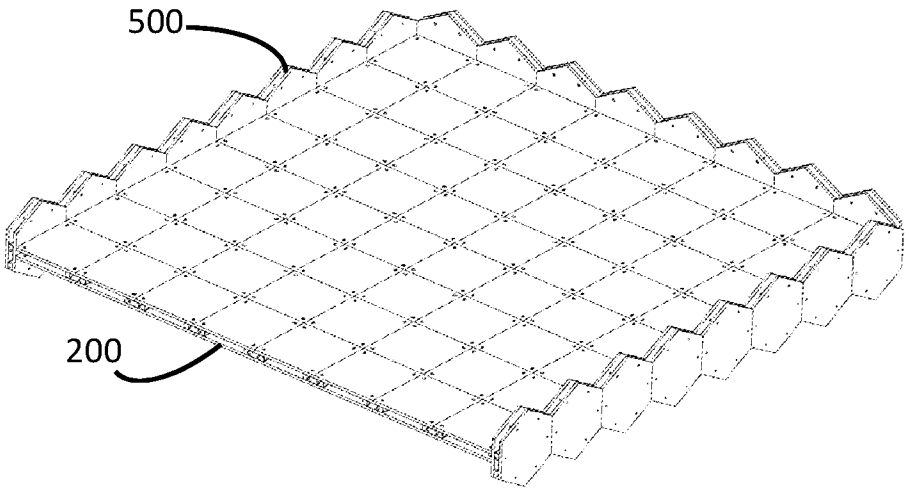
Figure 8B:
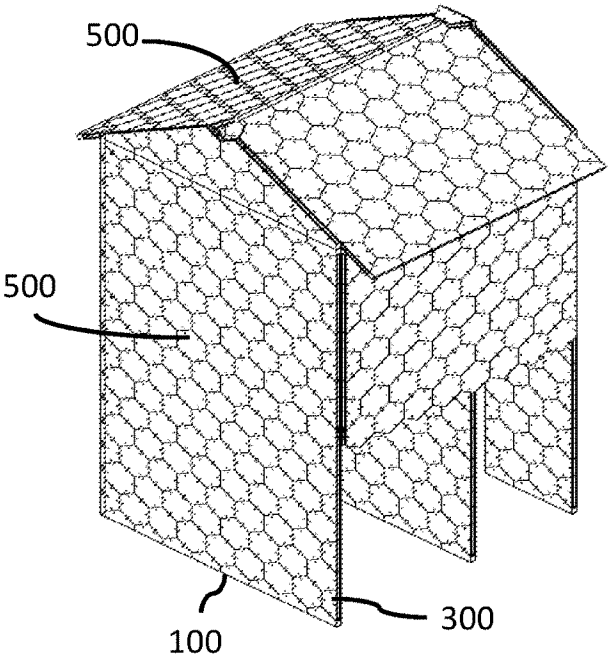
Figure 9A:
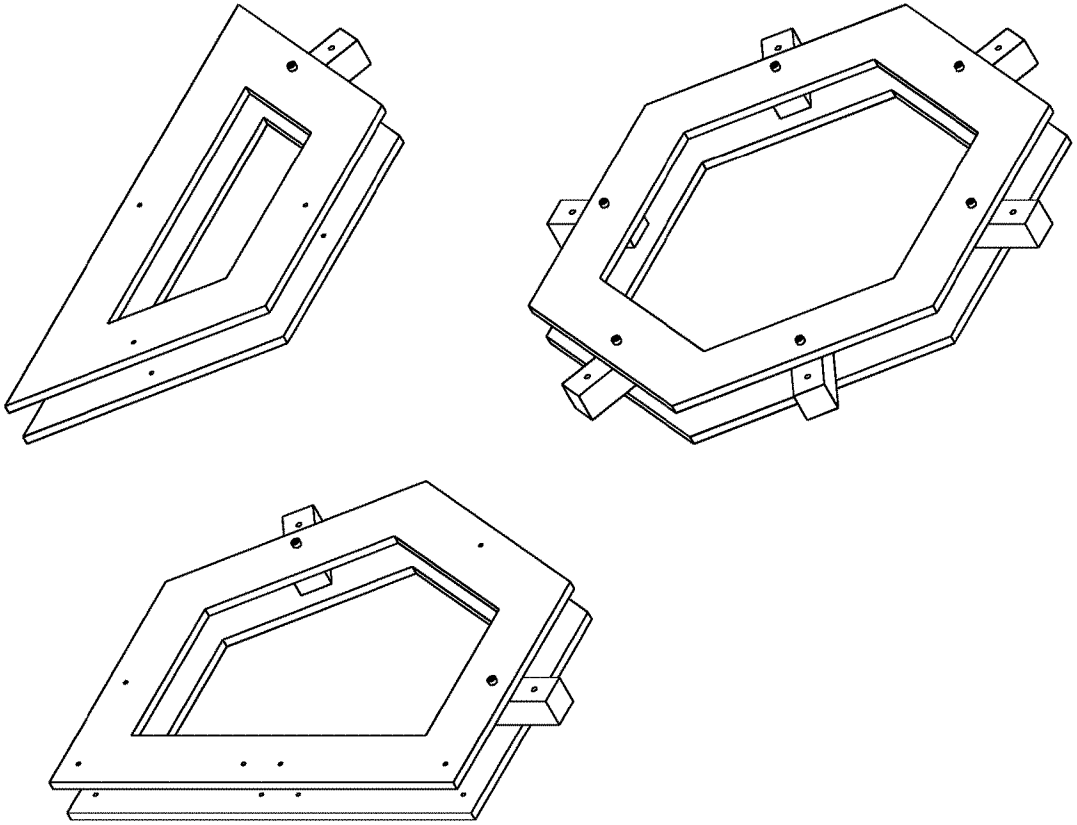
Figure 9B:
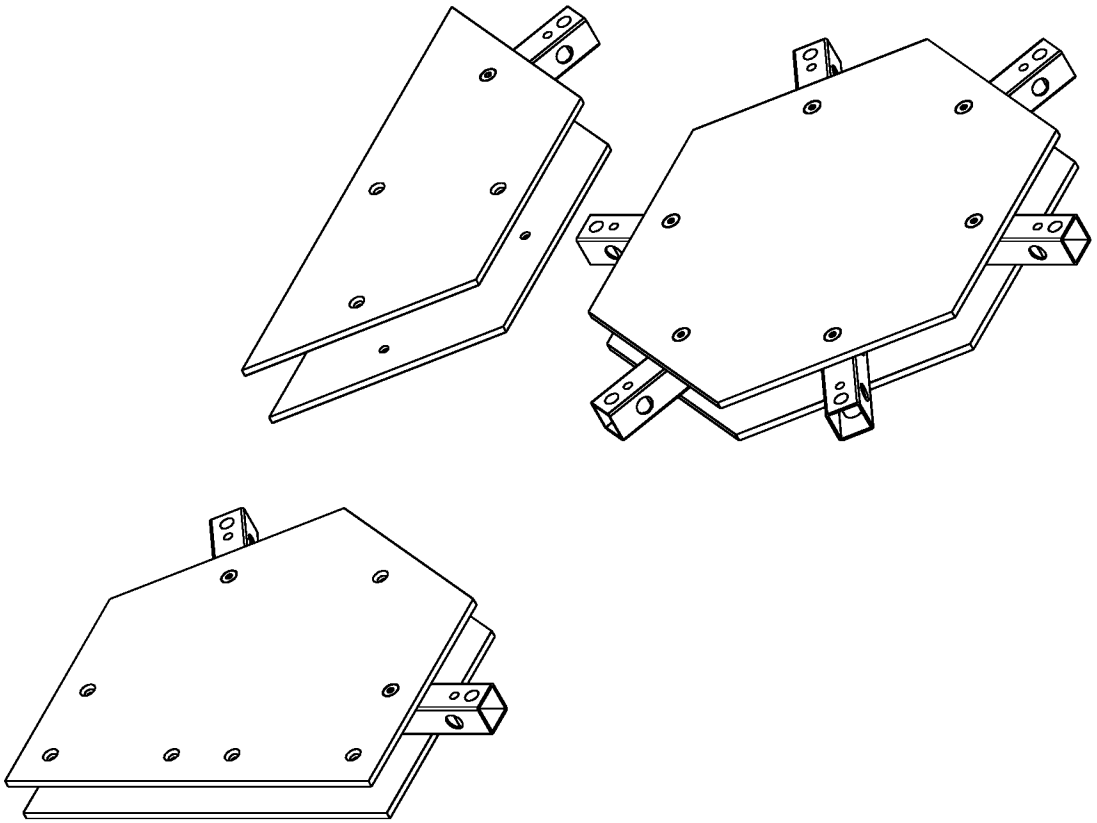

FIG. 8A-FIG. 8B illustrates a structure built by using an assembly with polygon shaped panel frames, separators and parts, in accordance with the preferred embodiment of the present invention; and FIG. 9A-FIG. 9B illustrates an embodiment by using hollowed frames and screws assembly with polygon shaped panel frames, separators and parts, in accordance with the preferred embodiment of the present invention.

DETAILED DESCRIPTION OF THE EMBODIMENTS

These and other features of the present invention will become readily apparent upon further review of the following specification and drawings. Other goals and advantages of the invention will be further appreciated and understood when considered in conjunction with the following description and accompanying drawings. While the following description may contain specific details describing particular embodiments of the invention, this should not be construed as limitations to the scope of the invention but rather as exemplifications of preferable embodiments. For each aspect of the invention, many variations are possible as suggested herein that are known to those of ordinary skill in the art. A variety of changes and modifications can be made within the scope of the invention without departing from the spirit thereof.

The following detailed description is intended to provide example implementations to one of ordinary skill in the art, and is not intended to limit the invention to the explicit disclosure. As one of ordinary skill in the art will understand, variations can be substituted that are within the scope of the invention as described.

The present invention for building structures using assemblies with polygon shaped panel frames, separators and parts allows construction of structures as simplified modular building pieces. The method eliminates the need of conventional framing and provides structural support and capacity through the pieces. The prefabricated panel frames are fabricated in basic geometric shapes like, circles, ovals, triangles, trapezoids, squares, rectangles, pentagon and hexagons. The smaller panel frames can fabricated from the larger frame panels.

Figure 1A:
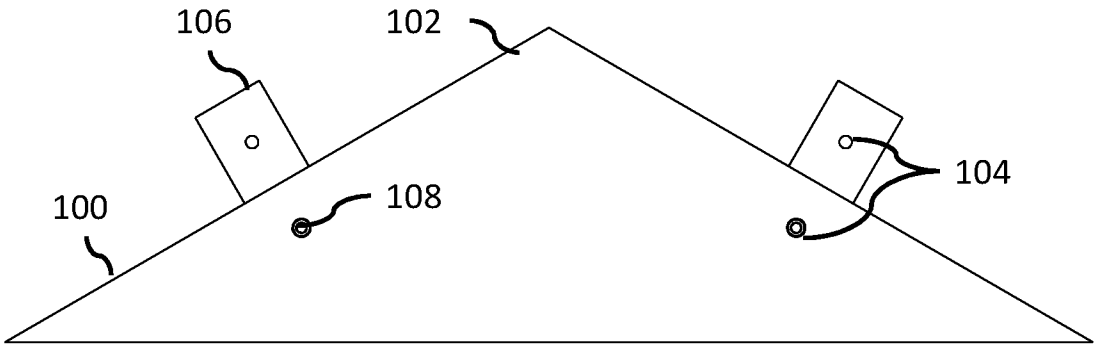
FIG. 1A and FIG. 1B illustrates a perspective view of the triangle panel frame, with links and fasteners used in assemblies with polygon shaped panel frames, separators and parts, in accordance with the preferred embodiment of the present invention.
Figure 1B:
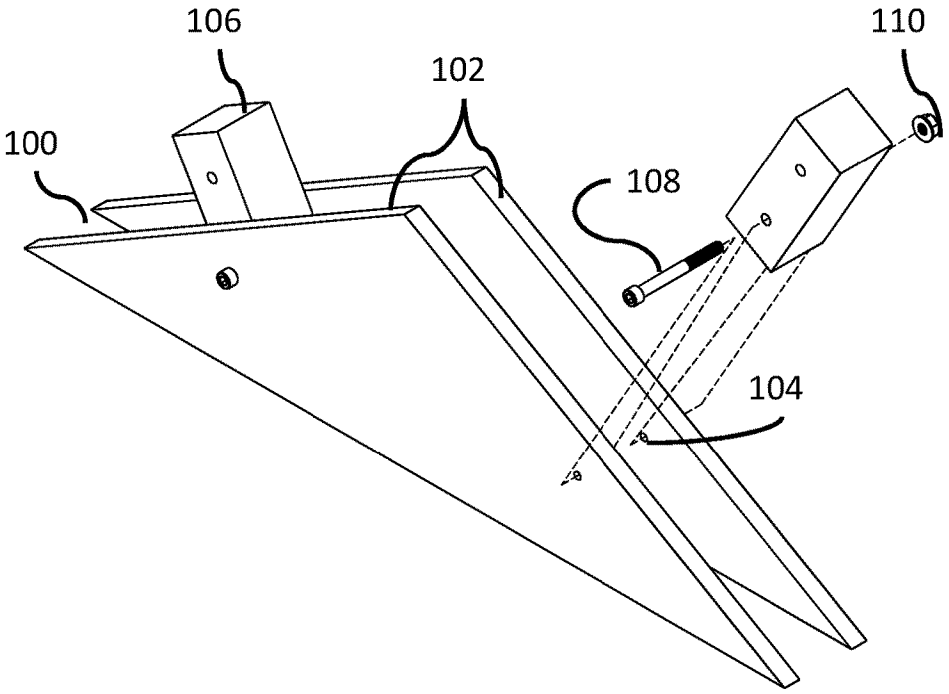

FIG. 1A and FIG. 1B illustrates a triangle assembly 100 used in assemblies with polygon shaped panel frames, link separators and parts in accordance with the preferred embodiment of the present invention. The triangle assembly 100 can be used at ends and can create straight edges.

The triangle assembly 100 includes a triangle panel frame 102 with holes 104 that are equidistantly spaced and located on the interior of the triangle assembly 100. Two triangle panel frame 102 are held together by link separators 106 that are fastened to the triangle panel frame 102 through fastening holes 104 held by a bolt 108 and nut 110 as shown in FIG. 1B.

Figure 2A:
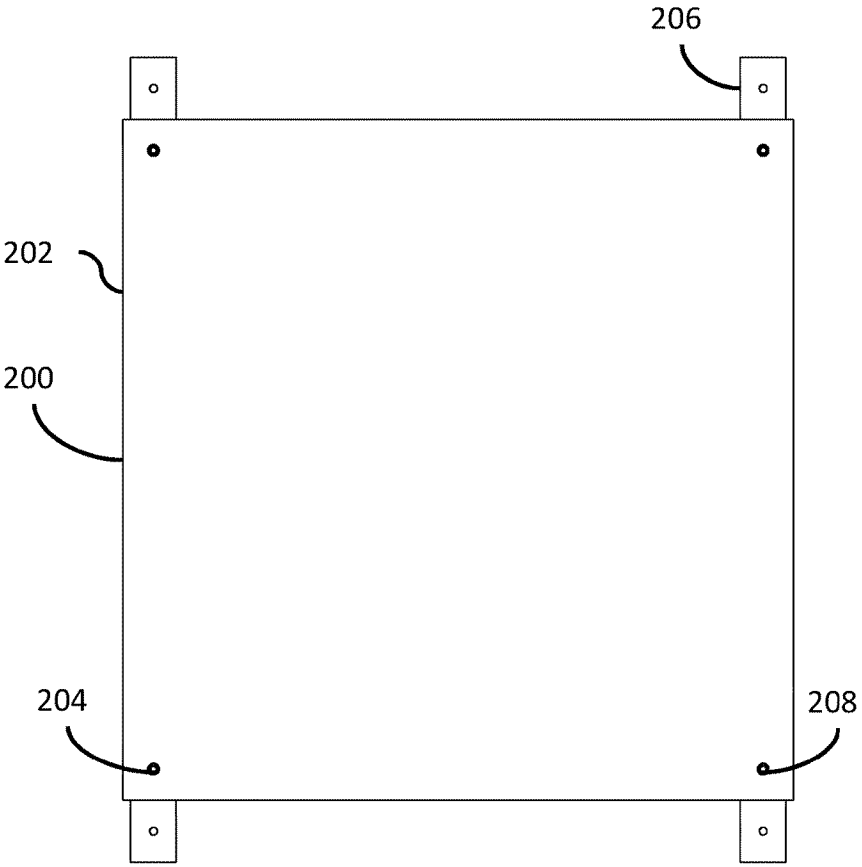
FIG. 2A and FIG. 2B illustrates a perspective view of the square panel frame, with links and fasteners used in assemblies with polygon shaped panel frames, separators and parts, in accordance with the preferred embodiment of the present invention.
Figure 2B:
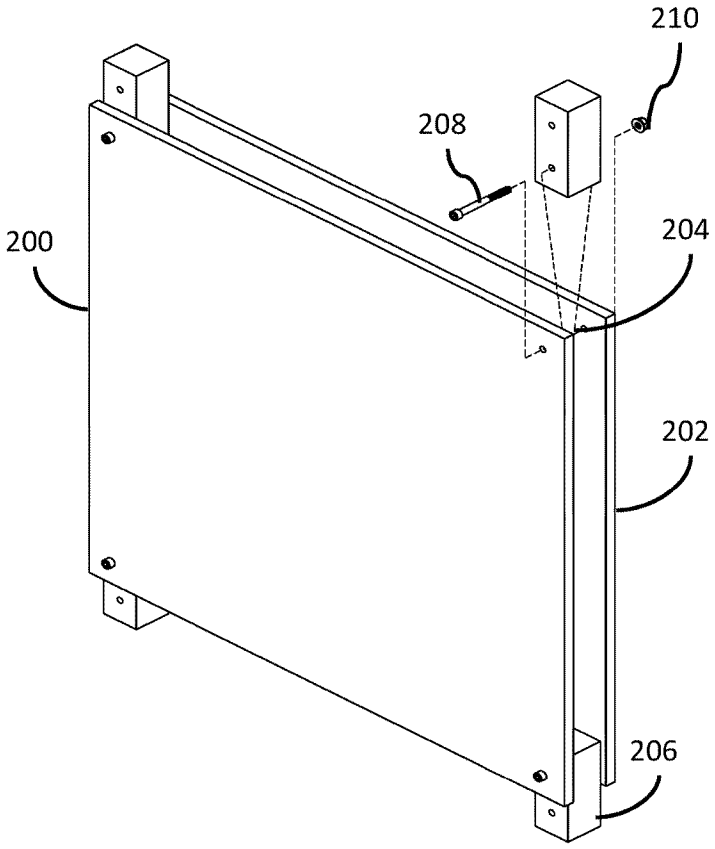

FIG. 2A and FIG. 2B illustrates a square assembly 200 used in assemblies with polygon shaped panel frames, link separators and parts in accordance with the preferred embodiment of the present invention. In one embodiment, the triangle assembly 200 is 24"×24"inches. The square assembly 200 can be used to make up the diaphragms, for example, floors, flat roofs, etc.

The square assembly 200 includes a square panel frame 202 with four alignment fastening holes 204 that are equidistantly spaced and located on the interior of the square assembly 200. Two square panel frames 202 are held together by link separators 206 that are fastened to the square panel frames 202 through fastening holes 204 held by a bolt 208 and nut 210 as shown in FIG. 2B.

Figure 3:
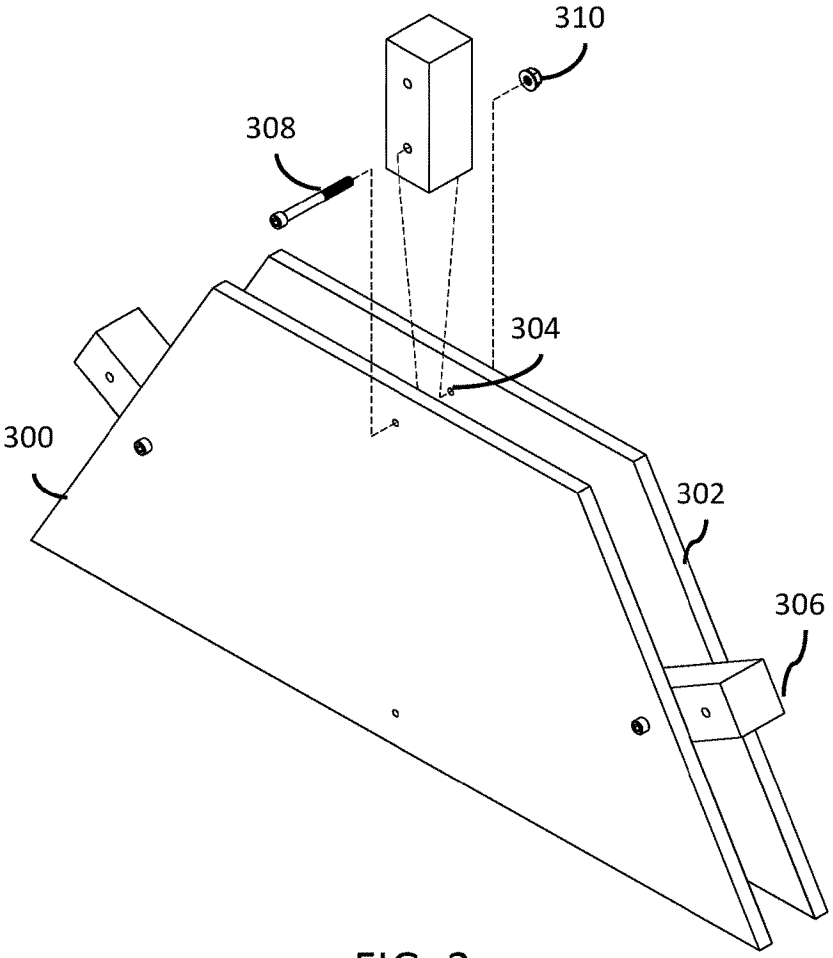
FIG. 3 illustrates a perspective view of the trapezoid panel frame, with links and fasteners used in assemblies with polygon shaped panel frames, separators and parts, in accordance with the preferred embodiment of the present invention.

FIG. 3 illustrates a trapezoid assembly 300 used in assemblies with polygon shaped panel frames, link separators and parts, in accordance with the preferred embodiment of the present invention. The trapezoid assembly 300 can be used at ends and can create straight edges. The trapezoid assembly 300 includes a trapezoid panel frame 302 with alignment fastening holes 304 that are equidistantly spaced and located on the interior of the trapezoid assembly 300. Two trapezoid panel frames 302 are held together by, link separators 306 that are fastened to the trapezoid panel frame 302 through fastening holes 304 held by a bolt 308 and nut 310 as shown.

Figure 4:
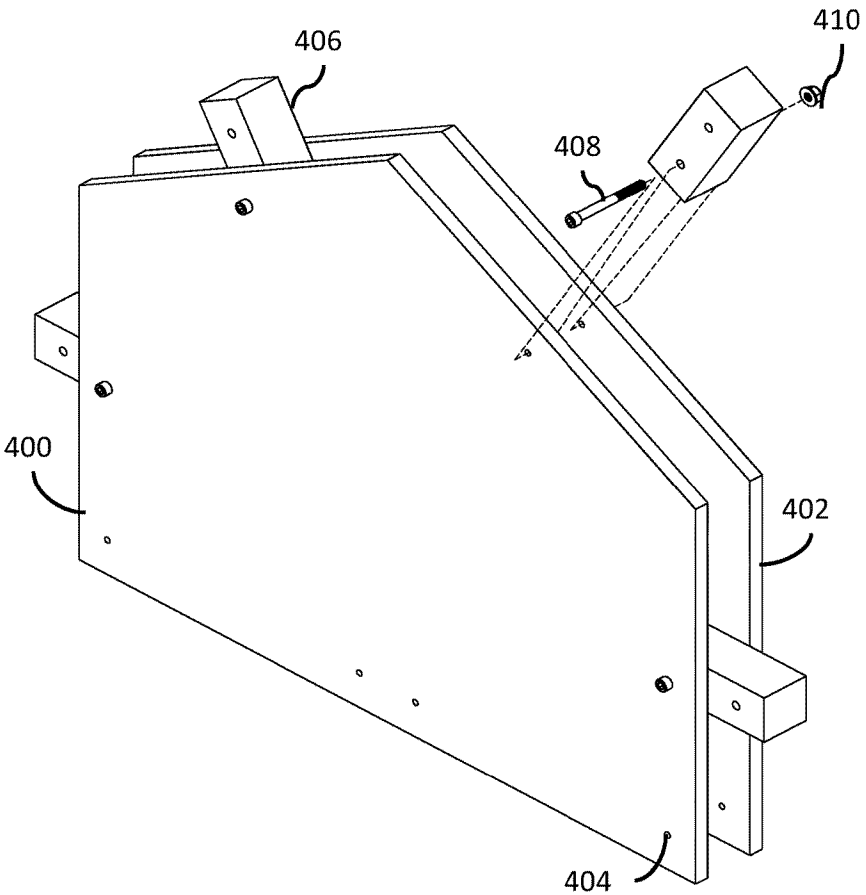
FIG. 4 illustrates a perspective view of the pentagon panel frame, with links and fasteners used in assemblies with polygon shaped panel frames, separators and parts, in accordance with the preferred embodiment of the present invention.

FIG. 4 illustrates a pentagon assembly 400 used in assemblies with polygon shaped panel frames, link separators and parts, in accordance with the preferred embodiment of the present invention. The pentagon assembly 400 can be used at ends and can create straight edges. The pentagon assembly 400 includes a pentagon panel frame 402 with alignment fastening holes 404 that are equidistantly spaced and located on the interior of the pentagon assembly 400. Two pentagon panel frames 302 are held together by, link separators 406 that are fastened to the trapezoid panel frame 402 through fastening holes 404 held by bolt 408 and nut 410 as shown.

Figure 5A:
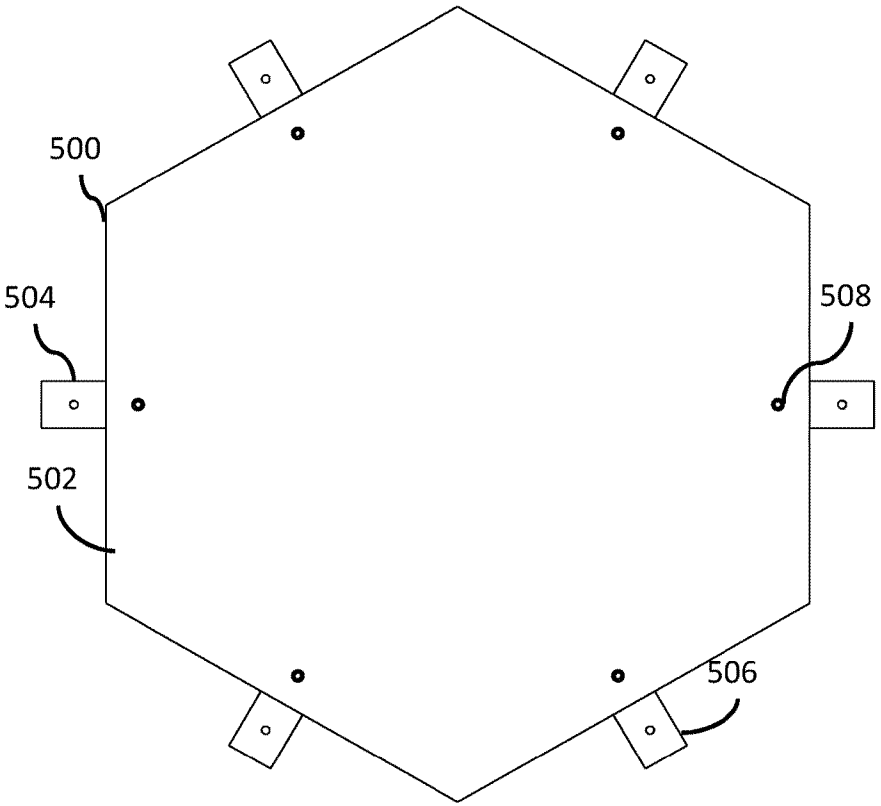
FIG. 5A-FIG. 5B illustrates a perspective view of the hexagon panel frame, with links and fasteners used in assemblies with polygon shaped panel frames, separators and parts, in accordance with the preferred embodiment of the present invention.
Figure 5B:
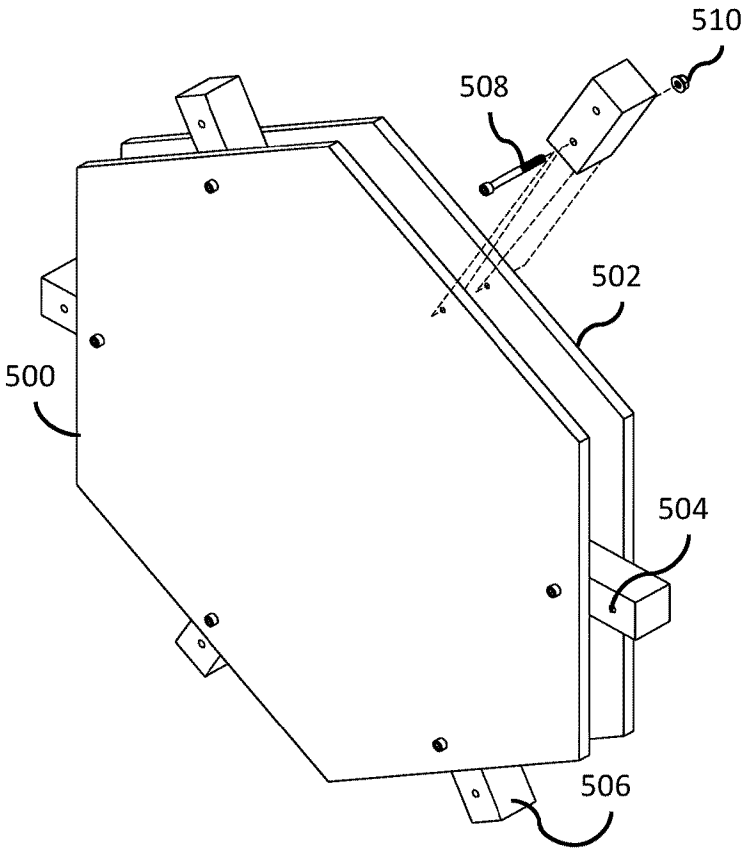

FIG. 5A-FIG. 5B illustrates a hexagon assembly 500 used in assemblies with polygon shaped panel frames, separators and parts in accordance with the preferred embodiment of the present invention. In one embodiment, the hexagon panel frame 500 is 13.86"×35"inches. The hexagon panel frame assembly 500 is primarily used for composition of the wall of the building structure.

The hexagon assembly 500 includes a hexagon panel frame 502 with six alignment fastening holes 504 that are equidistantly spaced and located on the interior of the hexagonal assembly 500. FIG. 5B illustrates the two hexagon panel frames 502. The two hexagonal panel frames 502 are held together by link separators 506 that are fastened to the hexagon panel frames 502 through fastening holes 504 held by bolt 108 and nuts 110 as shown in FIG. 5B.

Figure 6:
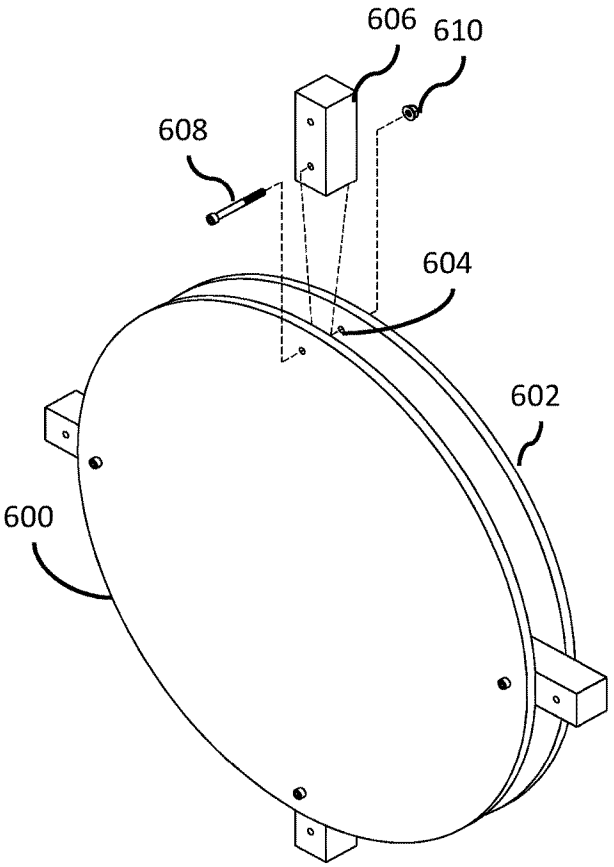
FIG. 6 illustrates a perspective view of the circle panel frame, with links and fasteners used in assemblies with polygon shaped panel frames, separators and parts, in accordance with the preferred embodiment of the present invention.

FIG. 6 illustrates a circle assembly 600 used in assemblies with polygon shaped panel frames, link separators and parts in accordance with the preferred embodiment of the present invention. In one embodiment, the circle assembly 600 is 24' inches. The circle assembly 600 includes a circle panel frame 602 with four alignment fastening holes 604 that are equidistantly spaced and located on the interior of the circle assembly 600. Two circle panel frames 602 are held together by link separators 606 that are fastened to the circle panel frames 602 through fastening holes 604 held by bolt 608 and nut 610 as shown.

Figure 7A:
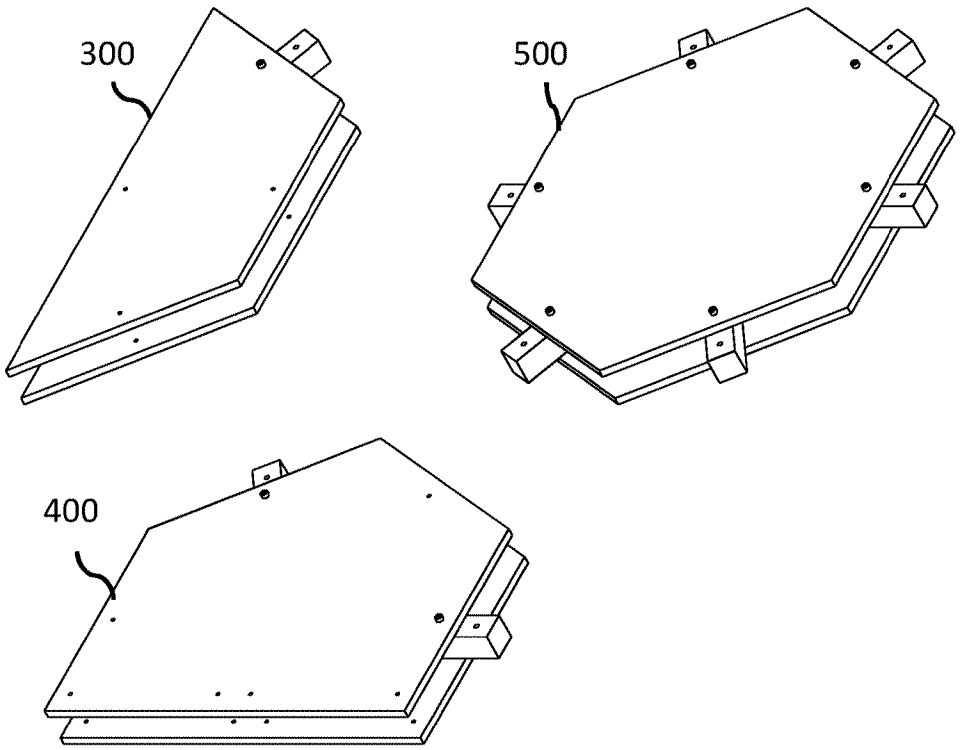
FIG. 7A-FIG. 7B illustrates a perspective view of the assembly and connections used in assemblies with polygon shaped panel frames, separators and parts in accordance with the preferred embodiment of the present invention.
Figure 7B:
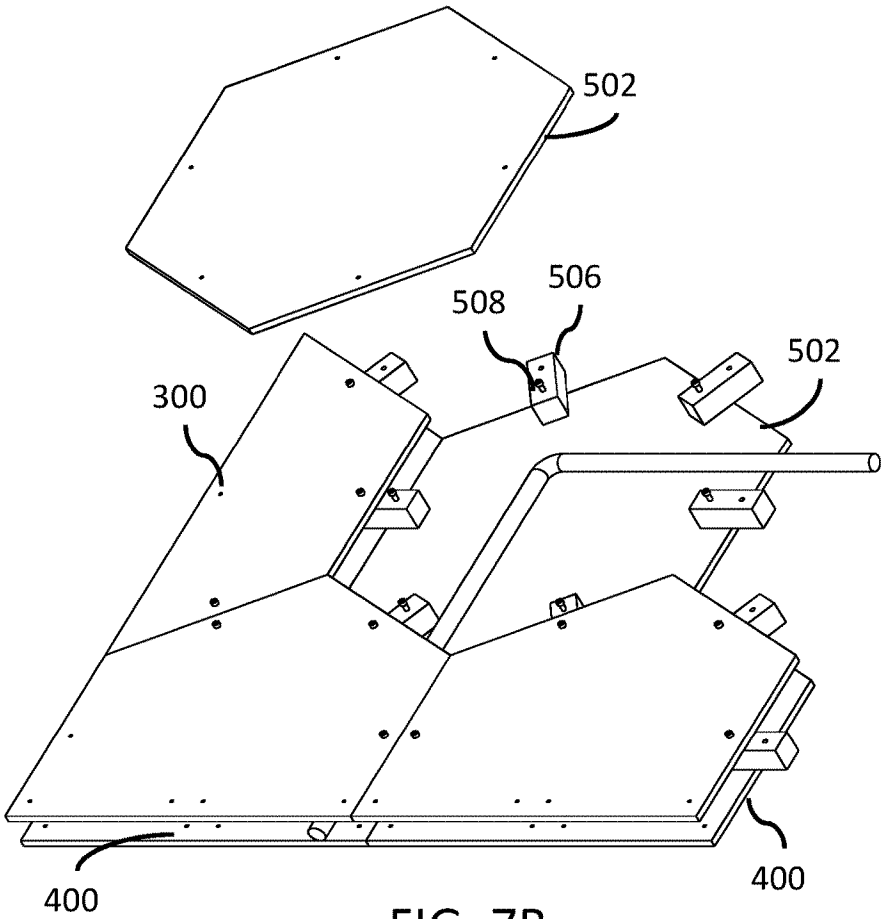

As shown in FIG. 7A and FIG. 7B according to one embodiment, construction of the building structure starts with the pentagonal assembly 400 on the foundation or used as the foundation, where the, link separators are placed in the pentagonal assembly, 400 and connected with bolts or nuts or couplers or standoffs The addition of the link separator and fasteners provides additional structural support to the pentagonal assembly 400. These points of connection provide nodal points and are strategically placed to be repetitive and couple with the next shape. As shown in FIGS. 7A and 7B pentagonal assemblies 400 are continued along the base and each board can be placed one at a time to couple the trapezoid assembly 300 and the hexagonal assembly 500 to achieve the desired geometry. These assemblies are connected by link separators and fasteners.

Advantage of using hexagonal assembly 500 is maximum composition since it is easy to repeat to achieve the desired shape. Only when straight edges are required pentagonal assemblies 500 and trapezoid assemblies 300 are incorporated.

FIG. 8A illustrates the exemplary connection assembly between the hexagonal assembly 500 and the square assembly 200. The squares assemblies 200 are used for floors, roofs and diaphragms. The square assemblies 200 are connected using the link separators and panel frames connected with fasteners. They have been dimensioned to match the width of hexagons so that no additional shapes will be necessary for a building if the building floor plan is either rectangle or square. The square assembly 200 attaches to each other and also to a link separator connected to the hexagonal assemblies 500 or trapezoid assemblies 400. The circle assemblies 600 can be substituted for the square assemblies 200.

FIG. 8B illustrates the modular structure built by assemblies with polygon shaped panel frames, link separators and parts in accordance with the preferred embodiment of the present invention. The building structure is predominately composed of the hexagonal assembly 500 with the trapezoids 300 and pentagonal 400 assemblies providing straight edges including wall terminations, openings like doors and windows, while the square, rectangle and circle assemblies are used for floors and flat roofs.

FIG. 9A-FIG. 9B illustrates an embodiment of assemblies with polygon shaped panel frames, link separators and parts in accordance with the preferred embodiment of the present invention. As shown in FIG. 9A, the panel frames can be hollowed and screws in wood can be used as fasteners. FIG. 9B illustrates connections using variations of fasteners including metal link separators, couplers and screws.

In order to achieve the desired geometry one can construct each shape assembly at a time or one panel frame at a time. According to one embodiment, structures can be assembled by fastening one panel frame to the prior laid shape assembly. Since each shape assembly is composed of layers of panel frames, one can connect the new board and then place the link separators connected to the panel frames, and install utilities if necessary. The assembly can be finished with the other frame to complete the shape assembly. As the building modules are laid, spaces can be created between the panel frames to allow ductwork, plumbing, wiring, and/or the like.

According to one embodiment, the material used can be of any typical construction material, like wood and wood by products (OSB boards, particle board), and additional structural support is dependent on material properties. Other types of materials can also be applied including, synthetics, polymers, plastics and composites. Additional supports consists of metal brackets, alignment attachments and washers.

Additional structural support elements consist of rubbers, metals, plastics, composites, glue, laminates, synthetics, etc.

According to one embodiment the material of the link separator can be tube steel, plastics, synthetics, polymers, composites, wood or any other type of desirable material that is structurally sound.

According to one embodiment, additional structural elements such as post tension, rebar, concrete and the like can be placed in the void created between the panel frames and link separators during assembly.

According to one embodiment the assemblies enable one to build the complete building structure as an assembly with the openings for doors and windows, eliminating the need of continuous vertical supports.

Furthermore, assemblies that include polygon shaped panel frames, link separators and parts, provide support with space for utility in which the electrical wiring conduits and plumbing can be effortlessly installed.

According to one embodiment, assemblies with polygon shaped panel frames, link separators and parts can be repeated to facilitate easy customization of the building structure.

Furthermore, the assemblies with polygon shaped panel frames, link separators and parts can be effortlessly reassembled and rearranged with low cost, efficient time, rudimentary skill and labor.

The following detailed description is intended to provide exemplary implementations to one of ordinary skill in the art, and is not intended to limit the invention to the explicit disclosure. As one of ordinary skill in the art will understand, variations can be substituted that are within the scope of the invention as described.

Although an illustrative embodiment of the invention has been shown and described, it is to be understood that various modifications and substitutions may be made without departing from the novel spirit and scope of the present invention.

Although an illustrative embodiment of the invention has been shown and described, it is to be understood that various modifications and substitutions may be made without departing from the novel spirit and scope of the present invention.

Accordingly, the disclosure of the present invention is intended to be illustrative, but not limit, the scope of the invention, which is set forth in the following claims.

The invention claimed is:

1. A system to build structures using planar panel framing pieces, comprising:

planar polygon shaped panel frames having two parallel portions, link separators, and fasteners for construction of the structure, wherein: the planar polygon shaped panel frames are pre-fabricated and include an entirely open portion between the two parallel portions, wherein the entirely open portion between the two parallel portions extends throughout a total area of the planar polygon shaped panel frames; the planar polygon shaped panel frames are connected together utilizing the link separator positioned in the entirely open portion between the two parallel portions with the fasteners to provide utility space for electrical and plumbing installations.

2. The system of claim 1 wherein the planar polygon shaped panel frames and the link separators are of different geometric shapes.

3. The system of claim 1 wherein the planar polygon shaped panel frames are pre-fabricated in basic shapes, wherein the basic shapes are circles, ovals, triangles, trapezoids, squares, rectangles, pentagons and hexagons.

4. The system of claim 3 wherein the pre-fabricated panel frames of same shape are held together by the link separators fastened through holes held by a bolt and nut.

5. The system of claim 1 wherein smaller planar polygon shaped panel frames are fabricated from larger planar polygon shaped panel frames.

6. The system of claim 1 and further comprising of: a triangle assembly configured with triangle frame panels and equidistantly spaced holes that are located in an interior surface, wherein the triangle assembly is used at ends to create straight edges.

7. The system of claim 1 and further comprising of: a square assembly that includes a square panel frame with four alignment fastening holes that are equidistance and located in an interior, wherein the square assembly is used to make diaphragms.

8. The system of claim 1 and further comprising:

a trapezoid assembly configured with a trapezoid panel frame with alignment fastening holes that are equidistance and located in an entirely open interior, wherein the trapezoid assembly is used at ends and straight edges.

9. The system of claim 1 and further comprising:

a pentagon assembly configured with a pentagon panel frame with alignment fastening holes that are equidistance and located in an entirely open interior, wherein the pentagon assembly is used at ends and straight edges.

10. The system of claim 1 and further comprising:

a hexagon assembly configured with a hexagon panel frame with six alignment fastening holes that are equidistance and located in an entirely open interior, wherein the hexagon assembly is primarily used for composition of a wall of the building structure.

11. The system of claim 1 and further comprising:

a circle assembly configured with a circle panel frame with four alignment fastening holes that are equidistance and located in an entirely open interior.

12. The system of claim 1 wherein the planar polygon shaped panel frames and the links separator are designed to repeat and provides a building structure with window and doorway openings.

13. The system of claim 1 wherein the planar polygon shaped frames are rearranged and reassembled to achieve a configuration.

14. The system of claim 1, wherein the link separators are operable to be affixed to the planar polygon shaped panel frames with the fasteners such that approximately a 90 degree angle is formed.

15. A method for building structures using layered panel framing pieces, the method comprising:

building structures using an assembly of a plurality of planar panel frames, each panel planar frame having two parallel portions, that are pre-fabricated and include an entirely open portion between the two parallel portions, wherein the entirely open portion between the two parallel portions extends throughout a total area of the planar polygon shaped panel frames; and building a geometry by assembling the plurality of planar panel frames, by operably affixing link separators to the planar panel frames by positioning link separators in the entirely open portion between the two parallel portions of the planar panel frames with fasteners, and further wherein the plurality of the planar panel frames is assembled such that utility space for electrical and plumbing installations are provided in the entirely open portion between the two parallel portions of the plurality of planar panel frames.

16. The method of claim 15 and further comprising:

using link separators and fasteners to assemble the plurality of planar panel frames.

17. The method of claim 15 and further comprising:

customization of the building structure by rearranging and repeating the assemblies of the plurality of panel frames, link separators thereby providing structural support to the building structure.

18. The method of claim 15, further wherein when the plurality of the planar panel frames are assembled by operably affixing link separators to the planar panel frames by positioning the link separators between parallel portions of the planar panel frames with fasteners, an approximately 90 degree angle is formed.

* * * * *